United States Patent [19]

Powers, Jr.

[11] 4,061,285

[45] Dec. 6, 1977

[54] METHOD AND APPARATUS FOR PACKAGING LINEAR MATERIAL

[75] Inventor: Thomas V. Powers, Jr., Anderson, S.C.

[73] Assignee: Owens-Corning Fiberglas Corporation, Toledo, Ohio

[21] Appl. No.: 685,591

[22] Filed: May 12, 1976

[51] Int. Cl.[2] ..... B65H 54/02; B65H 54/28

[52] U.S. Cl. ..... 242/18 R; 242/18 G; 242/43 R

[58] Field of Search ..... 242/18 G, 18 R, 18 DD, 242/18 B, 43 R

[56] References Cited

U.S. PATENT DOCUMENTS

| | | | |
|---|---|---|---|
| 1,799,153 | 4/1931 | Brink | 242/18 R |
| 2,165,018 | 7/1939 | Taylor | 242/18 R |
| 2,243,678 | 5/1941 | McKean | 242/18 R |
| 2,541,456 | 2/1951 | Bartak | 242/18 R |
| 2,665,076 | 1/1954 | Shontz | 242/18 R |
| 2,985,394 | 5/1961 | Nelson et al. | 242/18 R |
| 3,575,356 | 4/1971 | Campbell, Jr. | 242/18 DD |
| 3,697,007 | 10/1972 | Taylor et al. | 242/18 DD |
| 3,777,996 | 12/1973 | Torii | 242/18 R |

FOREIGN PATENT DOCUMENTS

| | | | |
|---|---|---|---|
| 1,180,114 | 2/1970 | United Kingdom | 242/18 R |

*Primary Examiner*—Stanley N. Gilreath

*Attorney, Agent, or Firm*—John W. Overman; Ronald C. Hudgens; Charles R. Schaub

[57] ABSTRACT

This invention relates to apparatus for collecting linear material defining a collector rotatable about a fixed axis onto which the linear material can be wound as a package. Located proximate the collector is a traverse guide for positioning the linear material on the collector. The traverse guide is urged towards the package at a substantially uniform pressure throughout the formation of the package by biasing means. The movement of the traverse guide is controlled by clutch means during formation of the package so that the traverse guide is restricted from moving towards the package.

3 Claims, 6 Drawing Figures

METHOD AND APPARATUS FOR PACKAGING LINEAR MATERIAL

BACKGROUND OF THE INVENTION

This invention pertains to apparatus for collecting linear material. In one of its more specific aspects, the present invention relates to apparatus for collecting a glass fiber roving material.

A great deal of technology has been developed on collecting a linear material and it is a common practice in the textile industry to collect continuous multifilament linear material such as strand, yarn and roving into a wound package on the spindle or collet of a winder. U.S. Pat. Nos. 3,838,827; 3,547,361 and 3,523,650 all show a portion of the technology that has developed to collect linear material.

One of the major problem areas in collecting linear material is that the parckages collected are not always uniform. The packages may have a density that varies, be out of round, or have other defects that make it difficult to unwind the material from the package. These problems become even more significant in view of the present trend to increase the size of the package that are collected. When the packages are collected a transverse guide places the linear material on the package and supplies a force to the material as it is placed on the package. The force from the traverse guide controls the density of the linear material on the package. The prior art mechanisms have not been able to keep a uniform force on the material as it is collected. If the variations in the force become too great the package may have unacceptable differences in density. In the larger packages it is even more difficult to have the traverse guided place the material on the package with a uniform force. Therefore, on the large packages there are more problems with the density of the packages.

An additional problem with the larger packages is that since it is difficult to place the linear material on the package with the same force throughout the formation of the package, an out of round package may develop. When an out of round package develops, the out of round portion has a tendency to strike the traverse guide. Since the package is large, the out of round portion can strike the traverse guide with enough force to temporarily move the traverse guide away from the package. The traverse guide then usually returns to the package with enough force that traverse guide again bounces away from the package. Since the out of round portion keeps striking the traverse guide as the collector rotates, the bouncing can continue throughout the formation of the package once an out of round package develops. Of course, since the traverse guide is bouncing, it cannot place the linear material on the package with a uniform force and the density of the material on the package is no longer uniform. Also, if the placement is sufficiently non-uniform it can be difficult or impossible to unwind the material from the package.

SUMMARY OF THE INVENTION

According to the invention there is provided apparatus for collecting linear material defining a collector preferably rotatable about a fixed axis, onto which the linear material can be wound as a package. Located proximate the collector is a movable traverse guide for positioning the linear material on the collector. The traverse guide is urged towards the package at a substantially uniform pressure throughout the formation of the package by a biasing means. The movement of the traverse guide is controlled by a clutch means during formation of the package so that the traverse guide will be restricted from moving towards the package.

An object of this invention is to provide improved apparatus for uniformly collecting a package of linear material.

Another object of the invention is to provide apparatus that places a linear material on a package with a substantially uniform pressure.

A further object of the invention is to provide apparatus that reduces the bouncing of the traverse guide during the formation of the package.

Other objects and advantages of the invention will become apparent as the invention is described hereinafter in more detail with reference being made to the accompanying drawings.

The apparatus of the invention is particularly useful in collecting filaments made from heat-softened mineral material such as molten glass. But the apparatus of the invention is useful for collecting other types of linear material, (for example, filament bundles such as yarn, cord, roving etc. as well as monofilaments) made from glass or other filament forming material, such as nylon and polyester. Thus, the term "linear material" used in the specification and claims includes monofilaments and filament bundles, including bundles of continuous or discontinuous synthetic filaments with or without twist, in addition to bundles of natural filaments.

DESCRIPTION OF THE PREFERRED EMBODIMENTS

Figure 1:
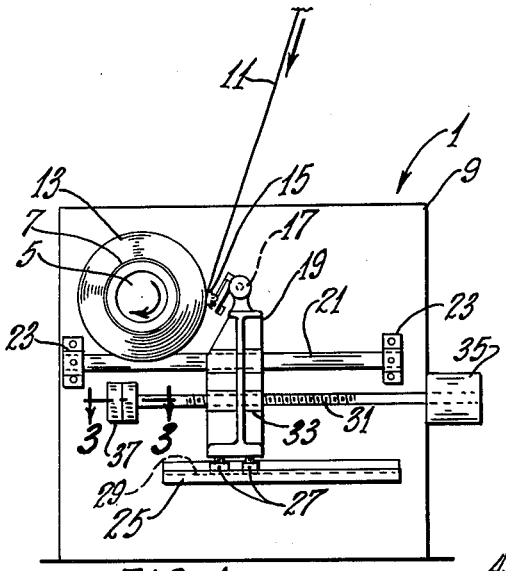
FIG. 1 is a side view of the apparatus for packaging linear material.
Figure 2:
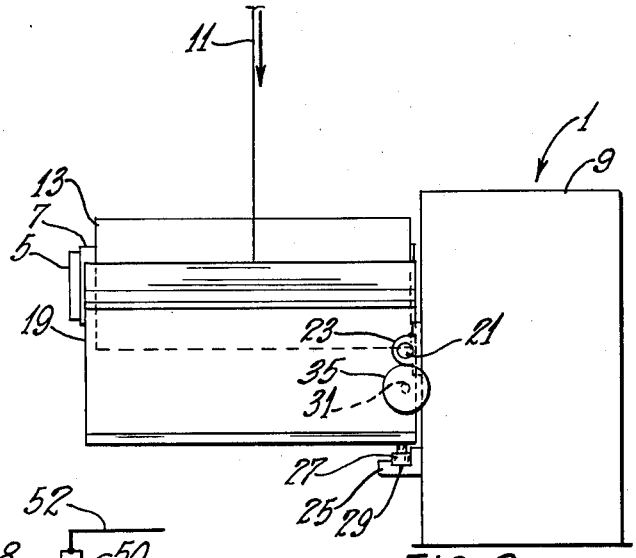
FIG. 2 is a back view of the apparatus for packaging linear material.

The invention will be more fully explained in the following descriptive material with reference made to the attached drawings. FIGS. 1 and 2 show a winder 1 for collecting linear material where the winder has a spindle or collet 5 that projects from the side of the winder. There is a tube 7 that fits on the collet of the winder and the tube is usually made of a plastic material. The collet of the winder is rotatable and is normally driven by a motor (not shown) that is located inside the body 9 of the winder. The linear material 11 is collected as a substantially cylindrical package 13 on the tube. A movable traverse guide 15 is used to position the linear material on the tube so that a uniform substantially cylindrical package is formed. The traverse guide is connected to a cam 17 and the cam is connected to a drive means (not shown). The traverse guide and cam are mounted on a movable support member 19. The support member is positioned on a member or bar 21 that is attached to the body of the winder 9 by two flanges 23. There are suitable bearings (not shown) in the support member where it rest upon the bar so that the support member can be moved along the bar. At the base of the support member is a track 25 that is used to support the base of the support member. Small projections 27 extend from the bottom of the base and the small projections mount slideably in a groove 29 located in the track 25. The bar 21 and track 25 hold the support member 19 in the proper vertical location and also allow the support member to move in a horizontal plane.

A rotatable ball screw 31 is connected to the support member by means of a ball nut 33 that is securely attached to the support member. The ball screw is supported at one end by a constant torque motor 35 that is attached to the body of the winder 9. The ball screw is also supported at the point where the ball nut is attached to the support member. The ball screw passes through the support member and on the end of the ball screw that is beneath the collet 5 there is a clutch coupling 37 and an overruning clutch 39. The clutch coupling is also attached to the body of the winder 9 and provides a support for the end of the ball screw that is connected to the clutch coupling.

Figure 3:
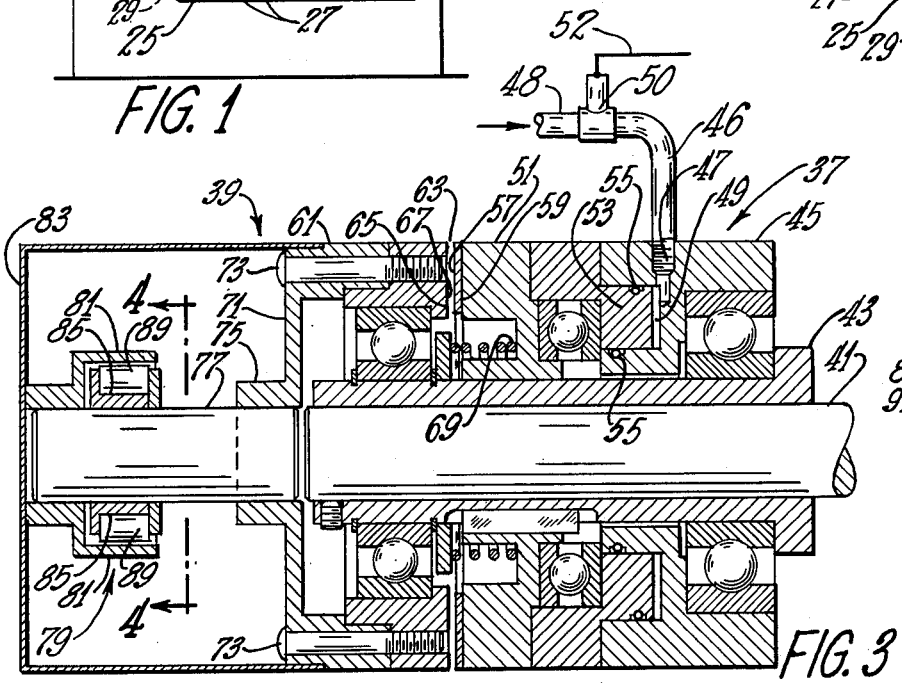
FIG. 3 is a side cross sectional view on an enlarged scale of the clutch coupling and the overrunning clutch taken along line 3—3 in FIG. 1.
Figure 4:
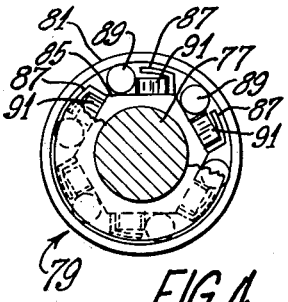
FIG. 4 is an end cross sectional view of the overrunning clutch taken along line 4–4 in FIG. 3.

The details of the clutch coupling 37 and overrunning clutch can be better understood by referring to FIGS. 3 and 4. The shaft 41 of the ball screw enters the clutch coupling 37 and passes through journal 43 and the journal is securely attached to the shaft of the ball screw. Rotatably attached to the journal there is the first portion 45 of the clutch coupling. The first portion of the clutch coupling has an air passageway 47 that is connected to a chamber 49. There is an air inlet line 46 connected to the air passageway. An air supply line 48 is connected to air inlet line 46 by a two-way solenoid valve 50. Attached to the solenoid valve is an electrical supply wire 52 that supplies current to activate the solenoid valve. The electrical supply wire is connected to the motor that rotates the collet so that when energy is supplied to the motor, energy is also supplied to the solenoid valve. Since there is an air inlet line attached to the air passageway the air passageway cannot rotate when the clutch coupling rotates. Accordingly, the first portion of the clutch coupling where the air passageway is located does not rotate when the clutch coupling rotates. In addition, the air supply line, solenoid valve and electrical supply wire are usually located in the interior of the winder housing so that these parts are not normally visable.

The second portion 51 of the clutch coupling is positioned adjacent the first portion of the clutch coupling. The second portion is attached to the journal 43 and first portion so that the second portion will rotate when the shaft of the ball screw rotates. However, the second portion is mounted so that it can slide along the journal in a longitudinal direction. The second portion is constructed so that it has piston 53 that connects to the air chamber 49 located in the first portion. O rings 55 are located along each sidewall of the piston and the sidewalls of the piston are in slideable engagement with the walls of the first portion. The second portion also has a friction face 57 that is located on the end wall 59 of the second portion.

A third portion 61 of the clutch coupling is positioned in spaced apart relationship from the second portion so that a small gap 63 is present between the second and third portions of the clutch coupling. The third portion is securely attached to the journal but the third portion is attached so that it does not rotate when the shaft of the ball screw rotates. The vertical portion of the end wall 65 that faces the gap, has a friction face 67 along the length of the end wall. There is also a return spring 69 that extends from the second portion across the gap and comes into contact with the third portion of the clutch coupling.

Attached to one end of the third portion is an adaptor 71. The adaptor is connected to the third portion so that when the third portion rotates the adaptor will also rotate. The adaptor connects the clutch coupling 37 to the overrunning clutch 39. The adaptor extends from its connection point 73 to form a cylindrical housing 75. A shaft 77 extends into the interior portion of the cylindrical housing and the shaft is therefore, securely attached to the adaptor. Therefore, whenever the adaptor 71 rotates, the shaft 77 will also rotate.

The shaft 77 also connects to the ratchet clutch 79 of the overrunning clutch 39. The outside race 81 of the ratchet clutch is securely attached to the end wall 83 of the overrunning clutch housing so that the outside race of the ratchet clutch will not rotate. A hexagonal cam 85 is securely attached to the shaft 77. Between the outside race and the cam there are a number of curved retainers 87 that extend from the cam to a location that is almost in contact with the interior surface of the outside race. Locking rolls 89 are also positioned between the cam and the outside race so that there is a roll between each of the curved retainers and the rolls are spaced apart from the curved retainers. A ribbon spring 91 can be used to help keep the rolls properly positioned so that the rolls are spaced apart from the curved retainers.

The operation of this apparatus can be more fully understood by referring to FIGS. 1–4 in conjunction with the following description. The strand of linear material 11 is advanced towards the winder 1 from a stand forming position or from a creel where a number of fibers are combined to form the strand. The linear material is collected as a package on the collet of the winder as it is rotated. In many cases the rotation of the collet supplies the force that advances the linear material towards the winder. The collet is usually rotated by an electric motor (not shown). The linear material is positioned on the collet by a movable traverse guide 15. The traverse guide is reciprocated back and forth along the length of the collet by a cam or other suitable drive mechanism (not shown) so that the linear material forms a cylindrical package. Of course as the package of linear material becomes larger the traverse guide must move further away from the collet to accommodate the increasingly larger package.

Since the traverse guide is mounted on the bar 21 and track 25 it can be moved away from the package to accommodate the increasing size of the package. The ball screw 31 that is connected to the support member 19, controls the movement of the traverse guide. The ball screw is connected to a constant torque motor 35 that initially rotates the ball nut 33 towards the collet until the traverse guide is in contact with the linear material that is positioned on the collet. The constant torque motor pushes the traverse guide against the linear material with a force that is equal to the amount of constant torque supplied by the motor. When the traverse guide is positioned against the package the motor stalls although the motor is still supplying the constant force or torque to the ball screw and the ball nut which in turn transmits this constant force to the support member and traverse guide. Then the motor that rotates the collet is started so that the collet begins to collect the linear material.

As the collet collects the linear material the package of linear material increases in size and the traverse guide must move away from the collet to accommodate this increasing size. However, the traverse guide is being held in its original position by the constant force being supplied by the stalled constant torque motor. Therefore, the package must increase in size until it exerts a force on the traverse guide that is greater than the force supplied to the traverse guide by the stalled constant torque motor. When the force from the package is greater than the force supplied by the constant torque motor, the traverse guide will move away from the collet. The movement of the traverse guide also moves the support member and ball nut away from the collet. The ball nut can only move away from the collet if the ball screw rotates in a direction opposite to the direction of rotation supplied to the ball screw by the constant torque motor. Therefore, the constant torque motor is rotated in the opposite direction or given a negative rpm by the movement of the traverse guide away from the collet. Of course, when the constant torque motor is rotated in the opposite direction it maintains a constant force on the ball nut and thus there is always a constant force on the traverse guide to resist the movement of the traverse guide away from the collet.

The clutch coupling 37 and overrunning clutch 39 also play an important role in the operation of the ball screw and the location of the traverse guide. When the traverse guide is first being positioned against the linear material that has been placed on the collet, the clutch coupling is disengaged and the ball screw can rotate freely to move the traverse guide into contact with the linear material. However, once electrical enery is supplied to the motor that rotates the collet, electrical energy is also supplied to the solenoid valve through the electrical supply wire. The electrical energy activates the solenoid valve so that air in the air supply line passes through the solenoid valve into the air inlet line and the air passageway 47. The air from the passageway fills chamber 49 in the first portion of the clutch coupling and causes the piston 53 in the second portion of the clutch coupling to move away from the chamber as the chamber expands due to the introduction of air. As the piston moves it causes the friction face 57 on the second portion to move against the friction face 67 on the third portion of the clutch coupling. When the two friction faces are pressed together the clutch coupling is activated and the third portion of the clutch coupling is united with the first and second portions of the clutch coupling. Since the overrunning clutch 39 is connected to the third portion by adaptor 71 and shaft 77 when the clutch coupling is activated, this also connects the overrunning clutch to the first and second portions of the clutch coupling.

The overrunning clutch has a ratchet clutch 79 that controls the rotation of shaft 77. The ratchet clutch is constructed so that when the shaft is rotated in the direction that the ball screw is rotated to advance the ball nut towards the collet, the rolls 39 will compress the ribbon springs 91 and move against the curved retainers 87. The rollers will move against the curved retainers with such force that it will cause the retainers to move out against the fixed outside race 81. When the retainers move out against the fixed outside race the retainers will bind and no longer move. When the retainers no longer move, the hexagonal cam 85 is immobilized and the shaft 77 is prevented from rotating.

Since the shaft 77 is connected through the clutch coupling to the shaft 41 of the ball screw, if shaft 77 is prevented from rotating this will also prevent the shaft of the ball screw from rotating. Accordingly, since the shaft 77 is prevented from rotating in the direction that advances the ball nut towards the collet, this will prevent the ball screw from rotating in this direction. Therefore, once the collet begins to rotate and air is supplied to the clutch coupling the ball screw cannot be rotated to move the traverse guide towards the collet.

However, when the shaft 77 is rotated in a direction that would move the ball nut away from the collet, the rolls will not move into the curved retainers. Instead the rolls will maintain their position spaced apart from the retainers and the retainers, cam and shaft 77 will be free to rotate. Since the shaft 77 is free to rotate the shaft 41 of the ball screw will be free to rotate. Accordingly, since the ball screw can rotate in this direction the traverse guide will be able to move away from the collet as the package builds in size.

If the collet is stopped for some reason, there will no longer be any electrical energy supplied to the electrical supply line. Without electrical energy to activate the solenoid valve the air from the supply line will no longer pass through the solenoid valve into the chamber 49. When the air no longer passes into the chamber the piston 53 will no longer hold the second portion in contact with the third portion of the clutch coupling. Thus, the return spring 69 between the second and third portions separates the second and third portions and deactivates the clutch coupling. This, in turn, disengages the overrunning clutch. Therefore, whenever the collet stops rotating the overrunning clutch is disengaged and the ball screw is free to rotate in either direction.

Figure 5:
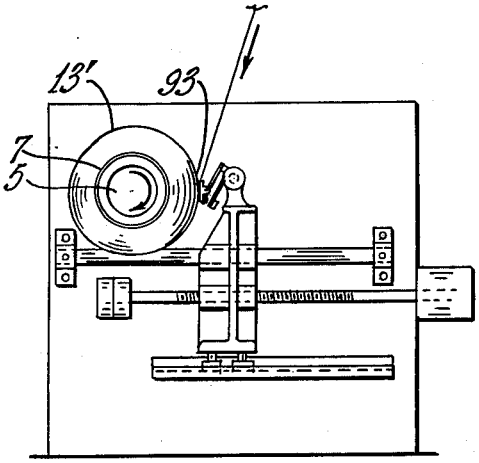
FIG. 5 is a side view of the apparatus for packaging linear material with an out of round package.
Figure 6:
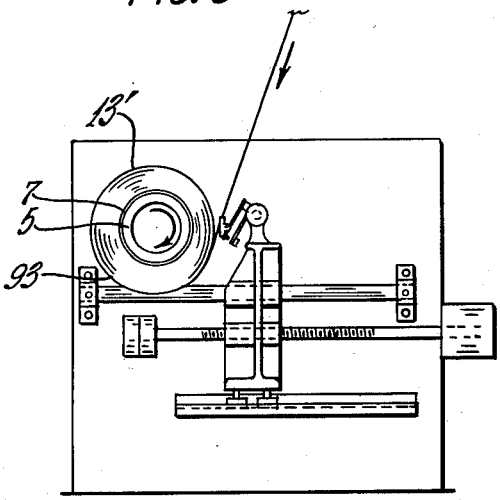
FIG. 6 is a side view of the apparatus for packaging linear material with an out of round package.

The significance of the overrunning clutch will be better understood by referring to FIGS. 5 and 6. In FIG. 5 an out of round package 13' is being built. The protruding portion 93 of the package will create a force on the traverse guide that will cause the traverse guide to move away from the collet 5. In FIG. 6 it can be seen that the traverse guide does not move back against the package after the protruding portion 93 of the package has moved away from the traverse guide. By having the traverse guide remain in the position where it only contacts the protruding portion of the package the traverse guide is kept from bouncing. Eliminating this bouncing helps to improve the uniformity of the linear material on the package. Also, with the traversing guide spaced apart from the package as shown in FIG. 6 the force exerted on the strand is reduced except at the protruding portion of the package, so that the strands will not be packed as tightly on the smaller portion of the package. Since the strands are not packaged as tightly on the smaller portion of the package this allows the smaller portion to build up more quickly and thereby eliminate the protruding portion of the package. Therefore, the overrunning clutch helps to eliminate any out of roundness that may develop in the packages.

In practice it has been found that a force in the range of 20–80 pounds should be supplied by the constant torque motor to the traverse guide. A force in this range flattens the material and places it tightly on the package. It has also been found that a force of approximately 35 pounds works particularly well when a glass fiber roving is being collected.

Having described the invention in detail and with reference to the drawings, it will be understood that such specifications are given for the sake of explanation. Various modifications and substitutes other than those cited can be made without departing from the scope of the invention as defined by the following claims.

I claim:

1. Apparatus for packaging linear material comprising:

a rotatable collector onto which the linear material can be wound as a package;

a movable traverse guide for positioning the linear material on the collector;

a rotatable ball screw movably connected to the traverse guide;

a motor for rotating the ball screw to urge the traverse guide towards the package;

a clutch coupling having a rotatable first portion fixedly attached to the ball screw and a rotatable second portion adapted to be placed in engagement with the first portion to securely engage the second portion with the first portion;

fluid employing means for engaging the second portion of the clutch coupling with the first portion when the collector is rotating; and, an overrunning clutch attached to the second portion of the clutch coupling, the overrunning clutch adapted to restrict the traverse guide from moving towards the package when the second portion of the clutch coupling is engaged with the first portion.

2. Apparatus of claim 1 wherein the motor is a constant torque motor which supplies a force of approximately 35 pounds to the ball screw to urge the traverse guide towards the package.

3. Method for packaging linear material comprising:

winding the linear material onto a collector to form a package;

positioning the linear material on the collector with a movable traverse guide;

urging the traverse guide towards the package with a ball screw movably connected to the traverse guide throughout the formation of the package;

engaging a rotatable first portion of a clutch coupling to a rotatable second portion of the clutch coupling with a fluid employing means when the collector is rotating, the first portion being fixedly attached to the ball screw; and, restricting the movement of the traverse guide towards the package with an overrunning clutch when the first portion of the clutch coupling is engaged with second portion of the clutch coupling, the overrunning clutch being connected to the second portion of the clutch coupling.

* * * * *